United States Patent [19]

Bleeck

[11] 3,950,931

[45] Apr. 20, 1976

[54] TRAVELER BRAKES FOR RING-TWINING AND RING-SPINNING MACHINES

[75] Inventor: Heinz Bleeck, Probstried, Germany

[73] Assignee: Saurer-Allma GmbH, Allgaeuer Maschinenbau, Kempten, Germany

[22] Filed: Oct. 30, 1974

[21] Appl. No.: 519,251

[30] Foreign Application Priority Data

Nov. 4, 1973 Germany ..... 2355065

[52] U.S. Cl. ..... 57/113; 57/78; 57/122

[51] Int. Cl.[2] ..... D01H 1/20

[58] Field of Search ..... 57/75, 122, 78, 113, 57/124

[56] References Cited

UNITED STATES PATENTS 758,275 4/1904 Paley ..... 57/113

1,665,422 4/1928 Setzer ..... 57/113 X

FOREIGN PATENTS OR APPLICATIONS 1,339,833 9/1963 France ..... 57/75

*Primary Examiner*—John Petrakes

*Attorney, Agent, or Firm*—Woodhams, Blanchard and Flynn

[57] ABSTRACT

A brake for the travelers of a twining ring or a spinning ring machine. Such machines have a series of rings each with an associated traveler and a common brake rod which can be operated to move braking units into the paths of the travelers. The braking units are made in ring form so that, when operated by the brake rod, they occupy substantially the whole of the paths of their associated traveler and can therefore engage the traveler and brake their motion wherever the traveler happen to be when the brake is applied.

10 Claims, 5 Drawing Figures

TRAVELER BRAKES FOR RING-TWINING AND RING-SPINNING MACHINES

FIELD OF THE INVENTION

The invention concerns a traveler brake for ring-twining and ring-spinning machines with a brake unit which is capable of movement into the path of motion of the traveler in order to brake the traveler and a brake rod acting on the brake unit in such a way that when the machine is being brought to rest several or all of the brake units on one side of the machine can be moved into the braking position.

BACKGROUND OF THE INVENTION

When a ring-twining or ring-spinning machine is brought to rest it is possible to observe the formation of curls or loops which are the more markedly present the greater is the degree of twist of the thread or twine. When the machine is started up again such curls may lead to difficulties since it cannot be guaranteed that the curls will be actually pulled out when the machine is started up. In addition, the thread or twine experiences a considerable loss of strength at the position of curling, which may lead to difficulties in further processing. The formation of curls may be ascribed to the fact that when the machine is brought to rest the machine itself comes to rest relatively quickly, because of the friction of the belt and of the bed and the action of the machine brakes, while the traveler, because of its low friction runs on for a longer time. In addition, the traveler also experiences additional acceleration due to the reaction forces produced in the thread by the twisting process. During normal operation, the traveler rotates at a speed corresponding to the speed of the spindle rotation less the velocity of the feed, i.e. in normal operation the traveler speed is always somewhat less than that of the spindle, but when the machine is shut off, the opposite situation occurs. The thread thus becomes slack and is able to curl up. Under favourable conditions it may also occur that the relation between the speeds of the spindle and traveler is maintained constant, so that the thread remains under tension until the machine comes to rest and no curls or only a negligible number are produced. But, in such cases, the traveler commences to move around the ring after the machine has come to rest because of reaction forces in the thread, so that yarn is unwound from the spool and the thread again becomes slack and able to form curls. Further, if during the shutting down of the machine, the speed of the spindle falls below a certain value, then the balloon of thread collapses so that a certain length of yarn becomes free and cannot be wound up again.

It is known (from French Patent Specification No. 1,339,833) to use a traveler brake in order to keep the thread under tension while the machine is being turned off. This traveler brake consists of a leaf spring which can be swivelled into the path of motion of the traveler. For this purpose the activating rod is designed as an axle extending in the longitudinal direction of the machine with one leaf spring attached to it for each twining-ring. When the machine is being turned off, the axle is rotated and the leaf springs are thus swivelled into their braking positions. In each of its rotations, the traveler strikes against the leaf spring and is braked by it. It is not, however, possible in this way to guarantee that the formation of curls will be prevented since the traveler is braked in the neighbourhood of the leaf spring only as long as it continues to rotate. When it comes to rest, after the machine has been turned off, at some particular point on the circumference of the twining ring then it may, because of the forces of reaction in the thread, move around the ring so that the thread becomes slack and curls up. In addition, it is disadvantageous that the traveler should be braked at a single point in its path of motion, since, in this case, a backward braking and thus an increase in the tension of the thread occurs at one point in its rotation, while in the rest of its path the traveler is able to turn freely without braking. The peaks of tension thus produced may lead to an impairment of the quality of the thread or even, under certain conditions, to breaking of the thread.

The basic object of the invention is therefore to design a traveler brake of the type described in the introduction which enables a uniform braking of the traveler throughout its motion and also the fixing of the traveler after it has come to rest.

This is achieved according to the invention in that the braking unit is designed to be ring-shaped and to extend over the whole path of motion of the traveler. By means of this design it is arranged that the traveler which has been brought to rest is fixed at whatever point on its rotation path it is situated. Thus the forces of reaction acting in the thread cannot move the traveler and the thread is held under continuous tension so that curls or loops can be eliminated with certainty. Since the braking unit extends in ring form over the whole path of motion of the traveler, the said traveler is braked uniformly over its whole rotation so that peaks of tension in the thread are avoided.

In order to improve the uniform action of the brake over the whole rotation further, it is convenient to provide the ring-shaped braking unit with a brake lining of an elastically flexible material on the faces opposite to the traveler. Foam rubber may be conveniently employed for this purpose. It is also possible to use soft rubber for this purpose.

An additional embodiment of the idea of the invention consists in that the braking unit is designed as a braking ring which can be moved up and down below the twining or spinning ring, the brake lining of said braking ring being able to be pressed against the traveler from below. Such a braking ring can be applied horizontally against the twining or spinning ring from below, preferably with the interposition of the above-mentioned brake lining, and thus makes possible a uniform braking effect over the whole path of rotation of the traveler.

BRIEF DESCRIPTION OF THE DRAWINGS

Embodiments of the invention are described in detail by way of example with reference to the accompanying drawings, in which.

DETAILED DESCRIPTION

The embodiments described are for a ring-twining machine, but the invention is also applicable in a similar manner to ring-spinning machines.

Figure 1:
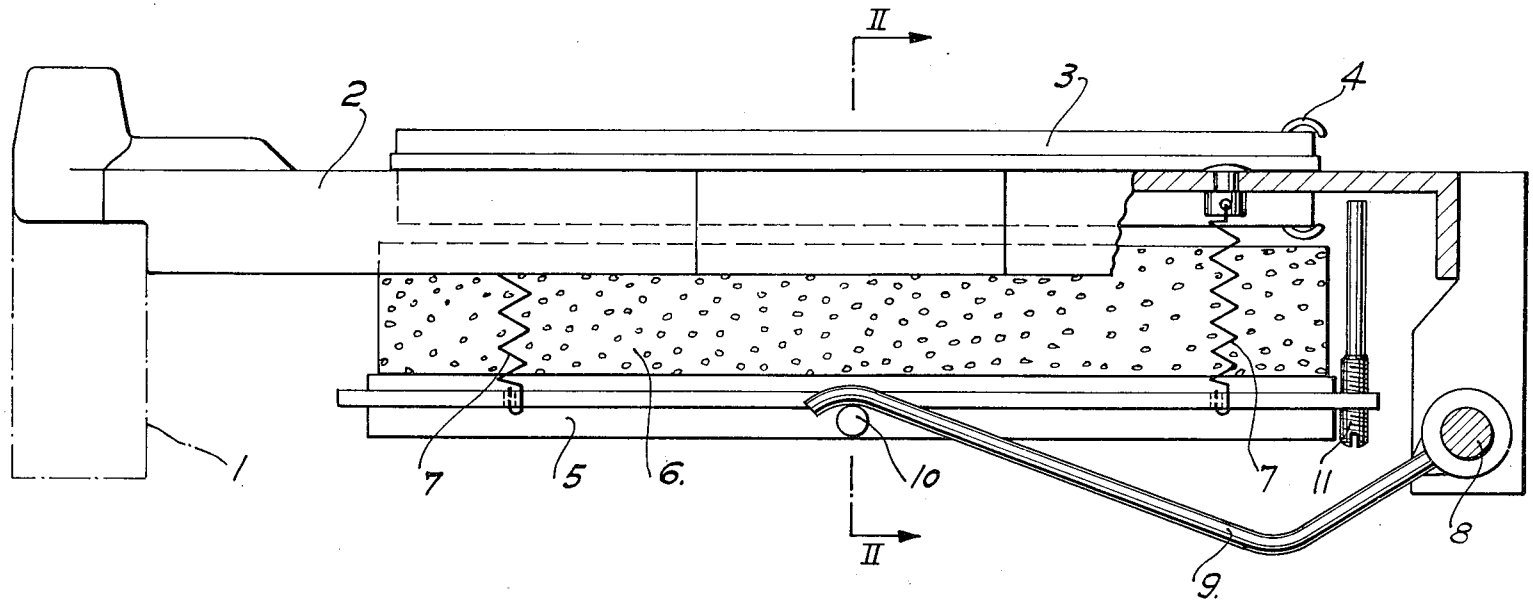
FIG. 1 is a side view of a first embodiment.
Figure 2:
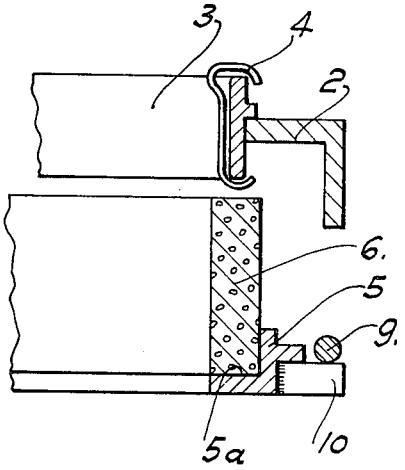
FIG. 2 is a cross-section along the line II—II of FIG. 1.

In FIGS. 1 and 2, ring holders 2 are fixed at a spindle separation distance on a ring bench 1, shown by dot-and-dash lines. These ring holders each carry a twining ring 3. A traveler 4 is guided on the twining ring 3 and is able to surround the upper and lower edges of the twining rings in a known manner.

Beneath the twining ring 3, coaxial therewith and parallel thereto is a braking ring 5, which can be moved up and down in the direction of an arrow A in FIG. 1. The braking ring has a brake lining 6 of foam rubber or soft rubber on its surface 5*a*, opposite to the traveler 4. If necessary, this brake lining could also consist of felt or of leather or be a brush. Foam rubber is, however, especially suitable since it allows a particularly soft braking of the traveler 4.

The braking ring 5 is hung from the ring holder 2 by means of four tension springs 7 distributed round its circumference and attached to the ring holder 2. The braking ring 5 with its brake lining 5 is pressed upward against the lower edge of the twining ring 3 by the tension springs 7. To activate the braking ring, a braking axle 8 extending in the longitudinal direction of the machine is provided and is able to be rotated through a limited range of angles by means of an electromagnet or the like. The braking axle 8 has a fork 9 for each braking ring, the said fork being supported against two pins 10 lying diametrically opposite to each other and arranged on the braking ring 5 parallel to the axle 8. The braking axle 8 extends over a group of twining rings or even over an entire side of the machine.

During twining the brake lining 6 should be held at a distance from the ring-traveler 4. This can be brought about in that one or several electromagnets act on the braking axle 8 and support it, when necessary, by means of springs (not illustrated) in the position shown in FIG. 1. Here the braking rings 5 are pressed downward against the force of the springs 7 so that the traveler 4 can rotate freely. In this case the electromagnets are conveniently so controlled by means of a time relay that the braking ring 5 is first brought into the working position illustrated in FIG. 1 shortly after starting-up the machine. When the machine is switched off the flow of current to the electromagents is interrupted so that the braking ring 5 is drawn upwards by the action of the springs 7. Its brake lining 6 comes into the path of motion of the lower part of the traveler 4 and brakes the traveler 4 uniformly. In order to produce a uniform and exactly defined braking action it is advantageous to limit the stroke of the braking ring in the direction towards the twining ring by means of adjustable stops, as for instance by setting screws 11. By means of these setting screws 11, the braking action can be adjusted to the prevailing conditions. In addition, the setting screws 11 can be adjusted when the brake linings 6 become worn and a certain functioning of the traveler brake can thus be guaranteed for a longer period of operation. During the time when the machine is at rest the traveler 4 is held securely at any point on its rotation path and cannot be again moved by the effect of the forces of reaction of the thread. During running of the machine, and also while the machine is at rest, the thread is always held under tension and thus curling-up and looping is avoided.

Figure 3:
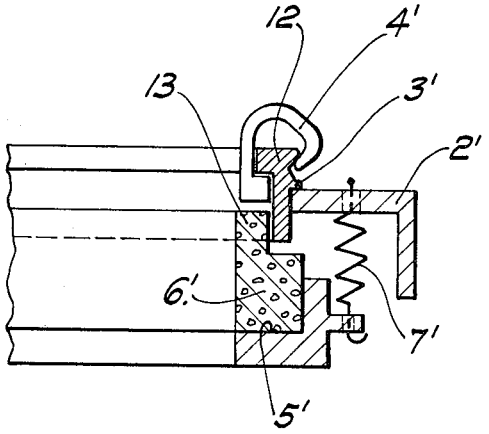
FIG. 3 is a partial cross-section through a second embodiment.

The embodiment illustrated in FIG. 3 differs from that illustrated in FIGS. 1 and 2 in the design of the twining ring 3'. In this type of twining ring the traveler 4' is only guided on the upper flange 12 of the twining ring. Correspondingly, the brake lining 6' has an extension 13 projecting into the interior of the ring 3', which, when the machine is shut off, once again applies itself against the under side of the traveler 4' by means of the springs 7' and is thus able to brake said traveler uniformly.

Figure 4:
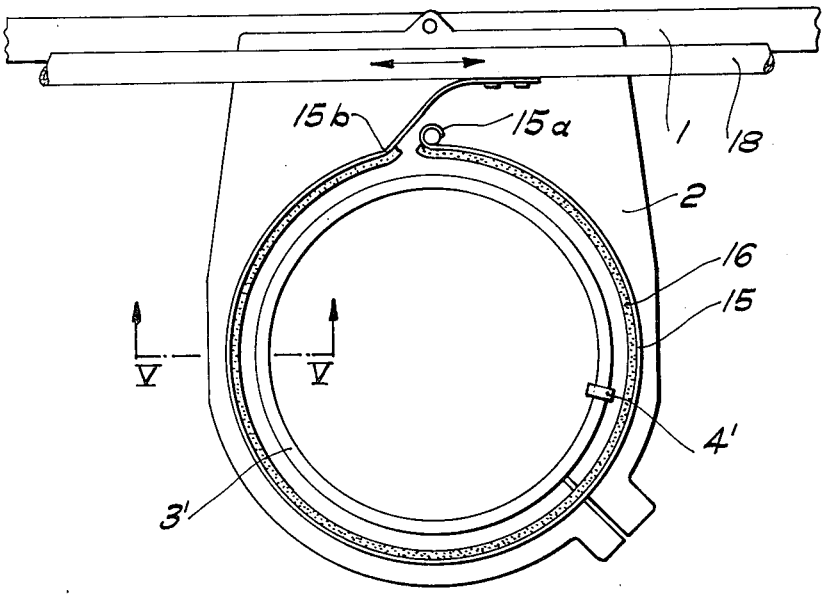
FIG. 4 is a plan view of a third embodiment.
Figure 5:
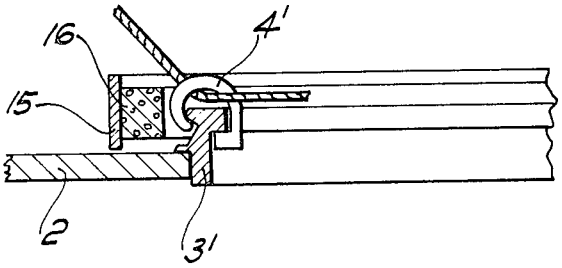
FIG. 5 is a partial section along the line V—V of FIG. 4.

The twining ring 3' and the traveler 4' corresponding to it employed in the embodiment of FIGS. 4 to 5 are to some extent similar to the twining ring and its corresponding traveler of the previously described examples of embodiment. In this case, the braking unit is designed as a type of band brake, whose brake band 15 surrounds the twining ring 3' externally at a distance. A brake lining 16, for instance of foam rubber, is once again provided on the inner side of the brake band. One end 15*a* of the brake band is fixed to the ring holder 2. The other end 15*b* is movable and is led close up to the fixed end 15*a*, so that when the brakes are applied, the two ends, or at least the ends of the brake lining, practically touch each other. With an elastic brake lining it might also be possible to design this as a closed ring. The movable end 15*b* of the brake band 15 is attached to a brake rod 18 which can be moved parallel to the ring bench 1. If the brake rod 18 is moved to the right then the brake lining 16 applies itself from the outside against the twining ring 3' or the traveler 4' and brakes this uniformly. Since the brake band 15, or the brake lining 16, is almost closed when the brakes are applied, the traveler is once again securely fixed in any position when at rest.

The embodiments of the invention in which an exclusive property or privilege is claimed are defined as follows:

1. A spinning or twining apparatus, comprising:

twining ring means having annular guide means thereon;

support means for supporting said twining ring means;

a traveler movably mounted on said annular guide means and guided for movement thereon;

an annular brake ring coaxially positioned relative to said twining ring means, said brake ring being composed of an elastically flexible material;

resilient means for resiliently suspending said brake means beneath said twining ring and for continuously urging said brake ring into braking engagement with the underside of said traveler, said material of said brake ring thereby minimizing wear on said traveler when said brake ring engages said traveler; and brake release means engaging said brake ring for urging said brake ring away from said braking engagement with said traveler against the urging of said resilient means.

2. A spinning or twining apparatus according to claim 1, wherein said brake ring is composed of foam rubber.

3. A spinning or twining apparatus according to claim 1, wherein said traveler is guided on both an upper and lower portion of said twining ring.

4. A spinning or twining apparatus according to claim 1, wherein said resilient means extends between said support means and said brake ring.

5. A spinning or twining apparatus according to claim 1, wherein said traveler is guided only on the upper flange of said twining ring and wherein said brake ring has an extension projecting into the interior of said twining ring to engage said bottom of said traveler.

6. A spinning or twining apparatus according to claim 1, wherein said brake release means comprises an axle extending in direction parallel to a tangent to said brake ring and a bifurcated member for said brake ring, said bifurcated member engaging a pair of diametrically opposite pins arranged parallel to said axle on said brake ring.

7. A spinning or twining apparatus according to claim 1, wherein the movement of said brake ring towards said twining ring is limited by adjustable stop means.

8. A spinning or twining apparatus, comprising:

twining ring means having annular guide means thereon;

support means for supporting said twining ring means;

a traveler movably mounted on said annular guide means and guided for movement thereon;

an annular brake ring concentrically positioned relative to and generally coplanar with said twining ring means, said brake ring being circumferentially noncontinuous to permit a movement of one end of said brake ring to effect a radial expansion and contraction of said brake ring relative to said twining ring means and said traveler, the other end of said brake ring being secured to said support means, said brake ring being composed of an elastically flexible material; and brake operating means operatively connected to said one end of said brake ring for effecting a radial movement of said brake ring into and out of engagement with a radial side of said traveler, said material of said brake ring thereby minimizing wear on said traveler when said brake ring engages said traveler.

9. A spinning or twining apparatus according to claim 8, wherein said one end of said brake ring is connected to a brake rod which is movable parallel to a tangent to said brake ring.

10. A spinning or twining apparatus according to claim 8, wherein said brake ring is outside said twining ring means, said brake operating means effecting a radial contraction of said brake ring to engage the radially outer surface of said traveler to halt the movement of said traveler.

* * * * *